United States Patent [19]

Funck

[11] 3,992,742

[45] Nov. 23, 1976

[54] GLUING PRESS FOR SHOES OR OTHER SIMILARLY SHAPED WORKPIECES

[75] Inventor: Herbert Funck, Am Wasserbogen, Germany

[73] Assignee: Dr. Ing. Funck K.G., Munich-Pasing, Germany

[22] Filed: Jan. 28, 1976

[21] Appl. No.: 653,021

[30] Foreign Application Priority Data

Jan. 28, 1975 Germany ..... 2503381
Oct. 31, 1975 Germany ..... 2548943

[52] U.S. Cl. ..... 12/1 F
[51] Int. Cl.[2] ..... A43D 00/00
[58] Field of Search ..... 12/1 R, 1 F, 1 W, 8.1

[56] References Cited

UNITED STATES PATENTS

| | | | |
|---|---|---|---|
| 1,895,941 | 1/1933 | Ritchey | 12/1 F |
| 2,489,643 | 11/1949 | Hunter | 12/1 F |
| 3,160,899 | 12/1964 | Bille et al. | 12/1 F |

*Primary Examiner*—Patrick D. Lawson
*Attorney, Agent, or Firm*—Edwin E. Greigg

[57] ABSTRACT

A gluing press for shoes or other similarly shaped workpieces having a pressure-medium operated pressure cushion whose highly resilient diaphragm fixes the sole to be attached during the gluing operation on the shoe upper placed on a last and retained in a shoe-receiving device, a feed movement taking place between the pressure cushion and the shoe-receiving device before the gluing operation. A switch is disposed on the shoe-receiving device the switch being constrainedly operated by the introduction of the upper shoe and switches on the drive for the closure movement of the operative parts of the gluing press formed on the pressure cushion and the shoe-receiving device. A safety device is connected to one of the operative parts of the gluing press which, when deflected by an obstacle in the path of movement of the movable part of the gluing press, switches off or reverses the drive.

19 Claims, 8 Drawing Figures

GLUING PRESS FOR SHOES OR OTHER SIMILARLY SHAPED WORKPIECES

BACKGRUND OF THE INVENTION

The invention relates to a gluing press for shoes or other similarly shaped workpieces, having a pressure-medium-operated pressure cushion whose highly resilient diaphragm fixes the sole to be attached during the gluing operation on the shoe upper placed on a last and retained in a shoe-receiving device, the pressure cushion and the shoe-receiving device being movable towards one another.

In the automated manufacture of shoes for a number of years gluing presses have become progressively more widely adopted in which the prefabricated walking soles are glued on to the shoe upper clamped on a last. Due to the development of suitable sole adhesives, more than 50% of all shoes are now glued.

In one construction of gluing press which has been used for a long time the shoe is placed with the sole to be glued downwards on a pressure cushion, whereafter a movable last support is lowered on to the last and/or the shoe upper. When the shoe upper is suitably supported, the pressure builds up in the cushion and then exerts on the last support via the walking sole and the last the contact pressure required for firm gluing. Since the shoe cannot be exactly fixed in position on the resilient pressure cushion, it must be retained by hand until the last support has seized from above and reliably held the last and the shoe. The majority of the various operations such as, for instance, the accurate adaptation of the sole to the upper, the insertion of the upper with the sole loosely applied and retention until the shoe is securely supported must be performed by hand. The mechanically performed operation such as, for instance, the lowering movement of the last support and the introduction of pressure meduim into the pressure cushion, are performed via hand or foot operated switches which are actuated separately. This comparatively complicated course of operations makes heavy demands on the operators, limits the possibilities of automation, causes considerable risks of accidents to the operators, and has the serious economic disadvantage that inexpert or inaccurate gluing of the soles to the uppers causes a relatively large number of rejects.

A substantial improvement of this construction is provided in the gluing press disclosed in German Auslegeschrift No. 1 685 395, in which the shoe is introduced with the sole upwards into a shoe-receiving plate formed with a correspondingly shaped aperture. The shape of the aperture in the plate and the weight of the shoe retain it in its position, so that there is no longer any need to retain the shoe in a dangerous manner during the lowering of the last receiving device. The lowering movement of the pressure cushion and its filling with pressure medium is initiated by a two-handed safety circuit. It is true that this type of machine reduces the risk of accidents, but its productivity is limited and is still determined to a very large extent by the technical knowledge of the operator. The machine also has the disadvantage that the closure movement of the gluing press is initiated by the extra actuation of hand or foot-operated switches only after a shoe upper, placed on the last and with the sole still loosely applied, is introduced into the aperture provided in the shoe-receiving plate; this places limits on the acceleration of the sequence of operational strokes, and results in faulty gluing and therefore a considerable amount of rejects due to inaccurate insertion of the shoe when machine output is raised.

The extra needed actuation of the hand or foot operated switches to initiate the closure movement and the following gluing operations can be another reason why the operator can have a negative effect on the quality of the gluing. If too long a time is left between the application of the soles, previously coated with adhesive, and the putting into effect of the contact pressure, the adhesive force of the glue may be reduced to such an extent that the soles become loosened from the uppers even after the footwear has been worn only for a brief period, and this results in claims which the shoe manufacturers find extremely unpleasant.

OBJECT AND SUMMARY OF THE INVENTION

It is an object of the invention, in a gluing press of the kind specified, to increase the number of operational strokes and therefore the production rate of the machine by the automatic coupling of the various operations, to reduce any possible effect which operators may have on the quality of gluing, and at the same time to eliminate to the greatest extent the risk of accidents to the operators due to, for instance, premature initiation of the closure movement.

One essential feature of the invention is that the insertion of the shoe in the receiving device initiates the relative movement of the operative parts of the press i.e., either the lowering movement of the pressure cushion or a movement of the shoe-receiving device out of the introduction position into the pressing position-and a follow-up control operated by the part of the gluing press which has been moved automatically starts the further operations until the gluing is completed. To exclude to the greatest possible extent the risk of injury to the operators, which is increased by the accelerated sequence of operational strokes, a safety system is provided which immediately interrupts or reverses the closure movement of the operative parts of the press as soon as a part of the body or some article gets into the path of movement of such part of the press. This feature of the invention is put into effect by the fact that disposed on the shoe-receiving device is a switch which is constrainedly operated by the introduction of the shoe upper and switches on the drive for the closure movement of the operative parts of the gluing press formed on the pressure cushion and the shoe-receiving device, and a safety device is connected to one of the operative parts of the gluing press which, when deflected by an obstacle in the path of movement of the movable part of the gluing press switches off or reverses the drive.

In a further development of the invention which is simple in construction and extremely reliable, the safety device is formed by a protective hood which can be moved synchronously with the pressure cushion and which, when the pressure cushion is raised, extends beyond its bottom edge and has coupled to it at least one emergency switch which switches off or reverses the pressure cushion drive when the synchronous movement is interrupted. As soon as the bottom edge of the protective hood lowered together with the pressure cushion impinges on an obstacle, for instance, a part of the operator's body, so that the protective hood is prevented from continuing its lowering movement, the emergency switch, advantageously disposed between the fixed pressure cushion wall and the protective hood, responds and switches off the drive for lowering the pressure cushion. This step reliably obviates the risk of accident due to the lowering movement of the pressure cushion. To improve response, the hood is of such dimensions and so designed that even relatively slight obstacles, such as the clothes of the operator, form an obstacle to the synchronous movement of the hood together with the pressure cushion, and this results in a response of the pressure operated switch, advantageously disposed between the hood and the pressure cushion, and therefore results in the switching off of the drive. Conveniently the material of which the hood is made is a plastic, preferably a transparent plastic.

The space available for the machine can be very advantageously utilized if the pressure cushion together with the protective hood is constructed to pivot around a lateral pivoting axis, the drive, constructed in the form of a double-acting pressure cylinder, being articulated to the fixed cover of the pressure cushion. In this embodiment the various switches for starting and stopping the drive can be disposed on the pivoting axis. If the protective hood, enclosing the pressure cushion at least partially, merely bears loosely against the pressure cushion in its raised position, the synchronous movement of both members is effected in an extremely simple manner merely by the weight of the protective hood. As soon as the pressure cushion makes a downward or upward movement, the protective hood follows such movement synchronously. That part of the hood wall which projects beyond the bottom edge of the pressure cushion during the lowering movement is of such dimensions that the lowering movement of the cushion can be reliably stopped within this distance.

In a further preferred embodiment of the invention, in which the pressure cushion and protective hood are borne in their closed position at the same level, namely the plate of the shoe-receiving device, the lowering movement of the cushion must not be interrupted if the protective hood is already in its bottom end position, in which its end face is borne on the plate. In this case, for the complete lowering of the pressure cushion a switch element is provided which is actuated by the protective hood latching into its end position and which renders inoperative the emergency holding switch responding to relative movements between the hood and the cushion.

In another embodiment the protective hood can also engage in or over a corresponding recess in the shoe-receiving plate and bear via its bottom edge against a stop whose level is displaced downwards by the height of the projecting edge of the hood, thus eliminating the necessity for the switch element to switch off the emergency holding switch.

Beyond the completely lowered protective hood the pressure cushion moves into its bottom pressing position, actuating a switch which starts the operations required for gluing, for instance, the introduction of pressure medium, the actuating of the time keeping for the preselected pressing time, and the release and lifting of the pressure cushion. During the lifting movement the pressure cushion entrains the protective hood.

In the gluing press according to the invention all that is needed, therefore, is to introduce the shoe manually into the receiving plate, whereafter all the further operations are automatic. The very rapid build-up of pressure in the pressure cushion, which is independent of the operator, and the always identical pressing times produce an improved gluing effect in comparison with the prior art machines and obviate the uneven cooling of the activated adhesive films.

A variant construction of the gluing press according to the invention has the important advantage of further increasing the operational rhythm with the resulting further relief, more particularly physiological relief of the operator. In this construction of a gluing press the shoe--receiving device can be moved for the insertion of the shoe upper out of its pressing position into a lateral introduction position, the switch actuated by the introduction of the upper into the shoe-receiving device immediately initiating the return movement of the shoe-receiving device from its lateral introduction position into the pressing position. The closure movement of the operative parts of the press can therefore consist of a lateral pivoting and displacing movement between the shoe-receiving device and the pressure cushion and a following movement together of the pressure cushion and the shoe-receiving device, or the simultaneous occurrence of both types of movement.

The lateral pivoting or displacing movement of the shoe receiving device in relation to the pressure cushion enables the shoe to be introduced freely outside the path of movement, and no steps need any longer be taken in the zone of movement between the pressure cushion and the shoe-receiving device. An important physiological aspect of this work is that during introduction by simultaneous actuation of the drive switch, the shoe is so to speak out of the hand of the operator, so that he is under no nervous strain and the rapidity of the closure movement is no longer determined by manual skill. However, the safety device on the press is still necesary, to make sure that no injuries are caused by unskilled handling or incorrect insertion of the shoe.

This construction of the gluing press according to the invention can be used very advantageously on completely automated production lines, since the shoe uppers can be introduced in an extremely simple manner, for instance, by means of a gripper device or manipulator into the shoe-receiving device, pivoted out into a precisely fixed position and having an exposed introduction aperture.

The receiving table can be given a lateral displacing movement is various ways. In one constructionally very simple further development of the invention the shoe-receiving device can be borne by a system of pivoting levers and be pivoted by a drive out of its pressing position; the system of pivoting levers is preferably formed by a V-shaped arm which can pivot around the pivoting axis and with which a piston rod of the drive, taking the form of a pressure medium cylinder, pivotably engages. On the other hand the shoe-receiving device is made more accessible and exposed if the system of pivoting levers comprises two lever arms, disposed in the form of a parallelogram and articulated at different heights to the frame, and also a toggle joint which locks the shoe-receiving device against the contact pressure. The amount of lateral displacement and also the inclined position of the shoe-receiving device can always be adjusted to the most favorable value by a suitable selection of arm lengths.

Another possible way of exposing the shoe-receiving device laterally is a pure displacement, to which end advantageously the shoe-receiving device, taking the form of a carriage, can be borne displaceably in a bed and be moved by a drive up to its pressing position into its introduction position. Extremely smooth displacement is achieved if rollers, balls or anti-friction bearings are disposed between the receiving carriage and the bed; in the fixed end positions such rollers, balls or anti-friction bearings are rendered inoperative, for instance, by spring-loaded recesses in the guides or the like, so that during the pressing and gluing operation the receiving table can be borne over a large area on the bed.

In dependence on requirements, the course of the closure movement between the pressure cushion and the shoe-receiving device can consist of two different types of movement, namely a lateral displacing movement of the shoe-receiving device and a lowering movement of the pressure cushion on to the shoe-receiving device moved into its pressure position. Both movements can be performed simultaneously or successively.

According to the invention the automatic course of the movements of the closing operation is performed by a number of switches acting on corresponding drives. A pressure-operated switch in the introduction aperture of the shoe-receiving device is actuated by the insertion of the shoe upper and switches on the drive for displacing or pivoting the shoe-receiving device which in the pressing position actuates a further limit switch which either switches on the drive for lowering the pressure cushion or initiates the further glueing operations with the pressure cushion stationary. With a lowerable pressure cushion, a further switch actuated by the lowered pressure cushion can perform these operations to complete the gluing.

Suitable design of the kinematics for the pivoting movement of the shoe-receiving device enables the lateral displacing movement to be combined with the movement towards one another, as a result of which only the shoe-receiving device must be moved and the pressure cushion can be incorporated fixed in the machine frame. This step enables the control of the gluing press to be considerably simplified.

In a further development of the invention, the safety device, taking the form of a visor, flap, strip, light or air barrier, can be disposed either on the shoe-receiving device or on the pressure cushion and in case of danger act on a safety switch which stops the whole press mechanism. The safety switch can be disposed either on the shoe-receiving device and the pressure cushion.

Due to the substantially rectilinear movement towards one another of the shoe-receiving device and the presure cushion towards the end of the closure operation, the sole loosely applied to the shoe upper is precisely fixed in position immediately before pressing. This is done by the highly resilient diaphragm which is disposed in the pressure cushion and which, before the pressure medium comes into action, is forced by the movement of the pressure cushion and the shoe-receiving device on to the walking sole to be glued. Due to its own elasticity, the diaphragm exerts a uniform pressure on the shoe sole and prevents sliding movements between the shoe upper and the sole during the actual pressing operation, such as frequently occur in prior art gluing presses and may result in the destruction of the glued connection.

The diaphragm is so softly resilient that during the pressing operation, under the effect of the pressure medium, it encloses the whole part of the shoe extending out of the shoe-receiving device, including the sole to be glued on, and is also borne on the surface of the shoe-receiving device. A sealing bead provided in the aperture of the shoe-receiving device is so constructed that the shoe upper is borne substantially at one level of its last. As a result, the pressure exerted by the contact pressure on the shoe sole is reliably intercepted. The continuous supporting of the shoe upper also has the advantage that the soft diaphragm cannot penetrate into any gap between the shoe upper on the last and the shoe-receiving device and become destroyed in such a gap.

To enable the press to be converted rapidly and in a very simple manner to various sizes and shapes of shoe, the inlet aperture for the shoe can either be worked into an interchangeable plate or the sealing bead can be constructed interchangeable.

Various embodiments of the gluing press according to the invention will now be described in detail with reference to the drawings, wherein:

DESCRIPTION OF THE PREFERRED EMBODIMENTS

Figure 1:
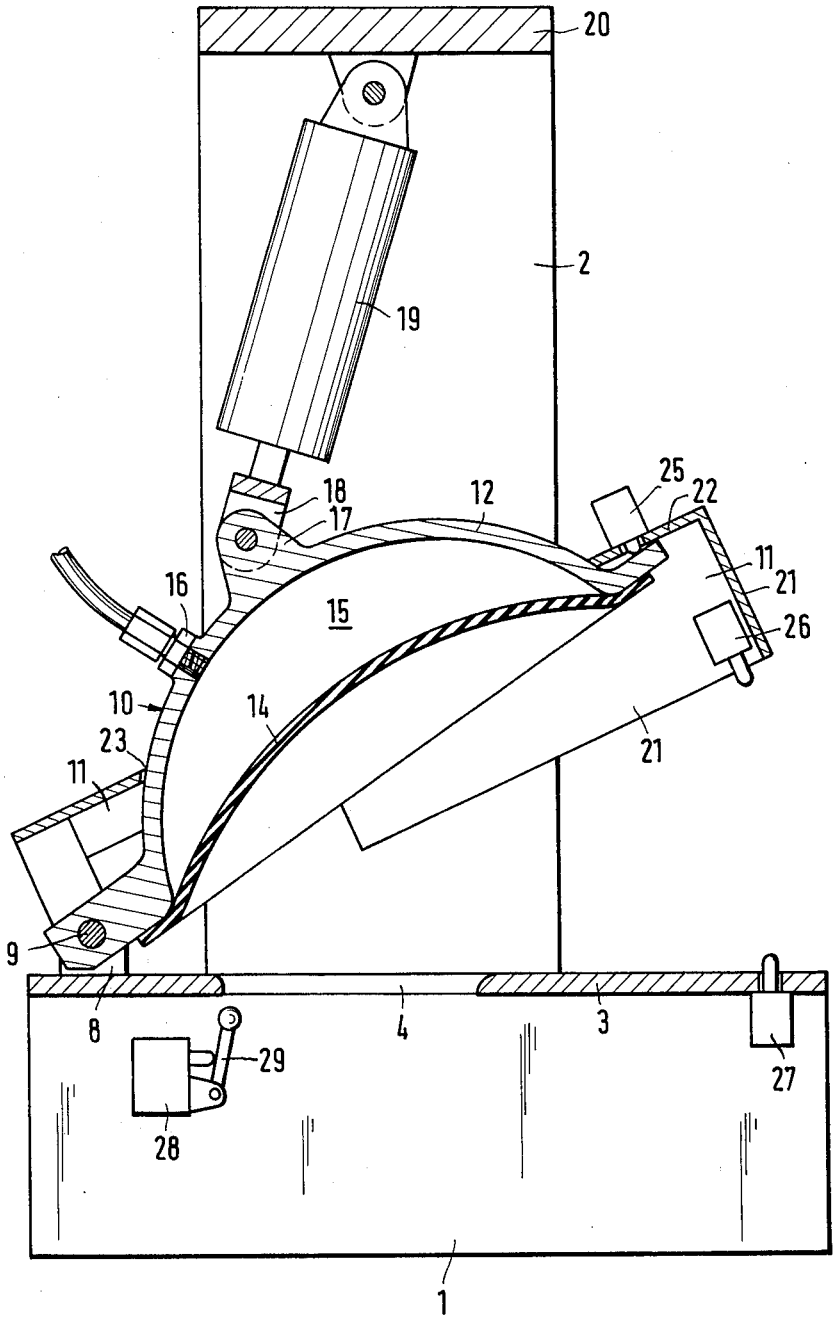
FIG. 1 is a diagrammatic vertical section through a first embodiment of the gluing press in the raised position.
Figure 2:
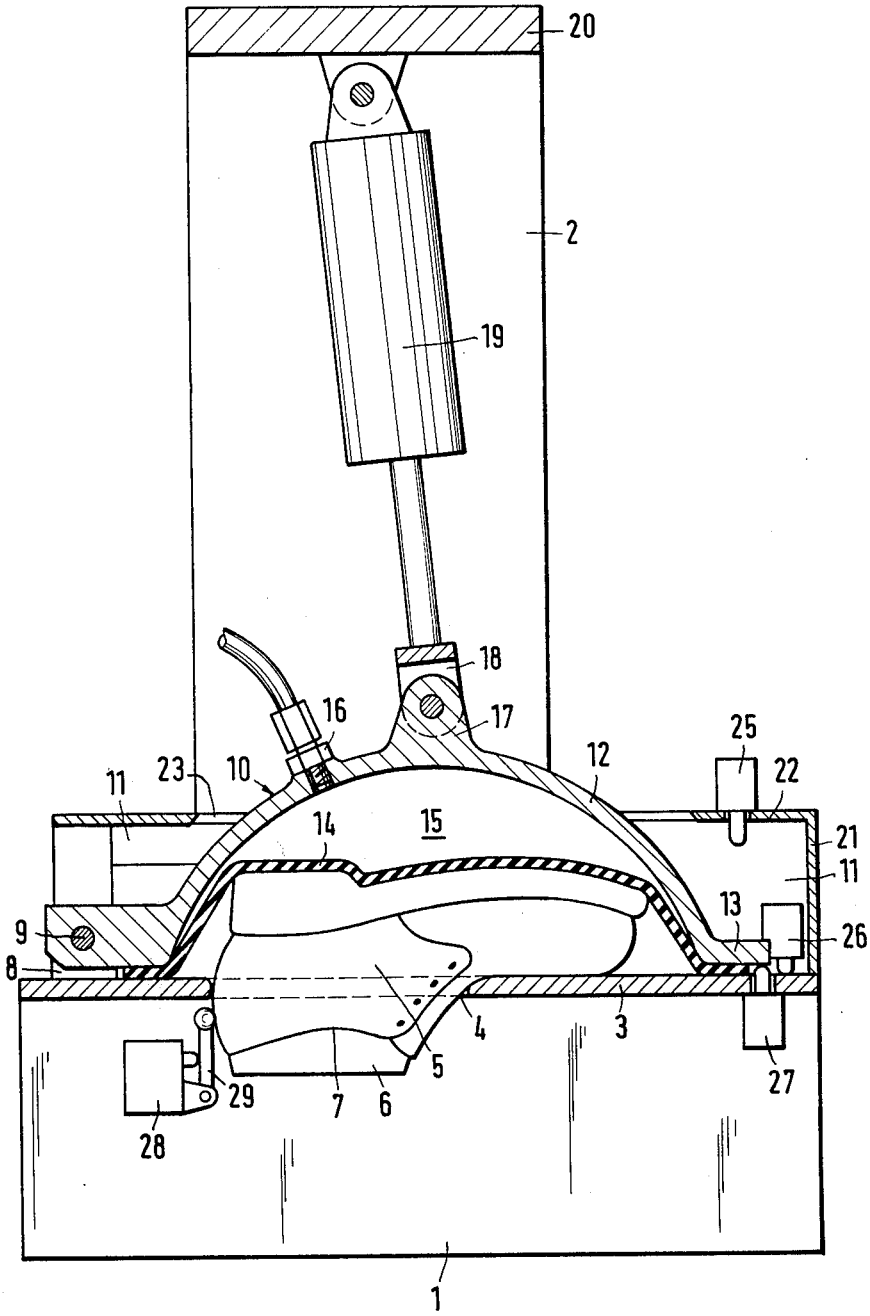
FIG. 2 shows the press illustrated in FIG. 1 in the closed position.

The gluing press illustrated in FIGS. 1 and 2 comprises a stationary frame 1 to which a column 2 is, for instance, welded. A plate 3 of the frame 1 contains an aperture 4 receiving a shoe 5 and so constructed that the shoe, clamped on a last 6, is borne over a large area and fixed in position, with its entry aperture pointing downwards, on the plate 3 or on a cushion part attached to the plate (FIG. 2).

Attached to the frame 1 laterally of the shoe-receiving aperture 4 are straps 8 for a pivot 9 around which a pressure cushion 10 and a protective hood 11 can be pivoted. The pressure cushion comprises an arcuate solid cover 12 merging at its bottom end into an annular flange 13. A resilient diaphragm 14 is attached sealed on all sides to the annular flange 13, the diaphragm 14 resiliently limiting a pressure space 15. A connection 16 is provided in the cover 12 for the introduction and discharge of the pressure medium. Articulated in the apex region of the cover 12 to a lug 16 is a piston rod 18 of a double-acting pressure cylinder 19 engaging pivotably with an upper transverse member 20 of the column 2.

Also pivotable around the pivot 9 is the protective hood 11 which partially encloses the pressure cushion 10 and, in the operational position shown in FIG. 1, extends by its edge 21 beyond the bottom edge of the pressure cushion 10. The top wall 22 of the protective hood is formed with a recess 23 and is applied loosely to the cover 12.

Attached to the hood is a sensitive pressure switch 25 whose feeler is forced in by the flange 13 of the pressure cushion in the operational position shown in FIG. 1. This switch acts as an emergency holding switch. Disposed on the side wall 21 of the hood 11 is a further pressure-operated switch 26 which, when the protective hood reaches its bottom end position, renders the emergency holding switch 25 inoperative. The plate 3 also comprises a switch element 27 whose actuation initiates the further operations with the pressure cushion completely lowered. Connected to the cushion drive 18, 19 is a further switch 28, attached to the frame 1, which starts or stops the drive.

To glue a shoe, the shoe 5 clamped on the last 6 is introduced into the aperture 4 in the manner shown in FIG. 2. The insertion of the shoe pivots the tilting member 29 of the switch 28 and therefore starts the pressure cylinder 19. The pressure cushion 10 is pivoted together with the protective hood 11 around the pivot 9 in the closure direction, the diaphragm 14 bearing loosely against the sole of the shoe 5. The hood is not driven separately, but follows by its own weight the lowering movement of the cushion. As soon as the wall 21 of the hood 11 extending beyond the bottom edge of the cushion bears against the plate 3, the switch 26 is actuated, acting on the emergency holding switch 25 to render the latter inoperative. As a result, the lowering movement of the cushion 10 can be continued without interruption as far as the complete closure position. In the bottom end position the flange 13 actuates the switch 27 which initiates the further operations - i.e., opens the cutoff valve to introduce a pressure medium into the pressure cushion chamber 15, starts a timer for the predetermined pressing time, and after such time has elapsed, starts the pressure cylinder 19 to raise the pressure cushion and protective hood. As soon as during the downward movement of the pressure cushion any article arrives in the path of movement of the protective hood, the further downward movement of the hood is interrupted and as a result the emergency holding switch 25 is actuated which either cuts off or reverses the pressure medium supplied to the piston 19, so that the cushion is raised again.

Figure 3:
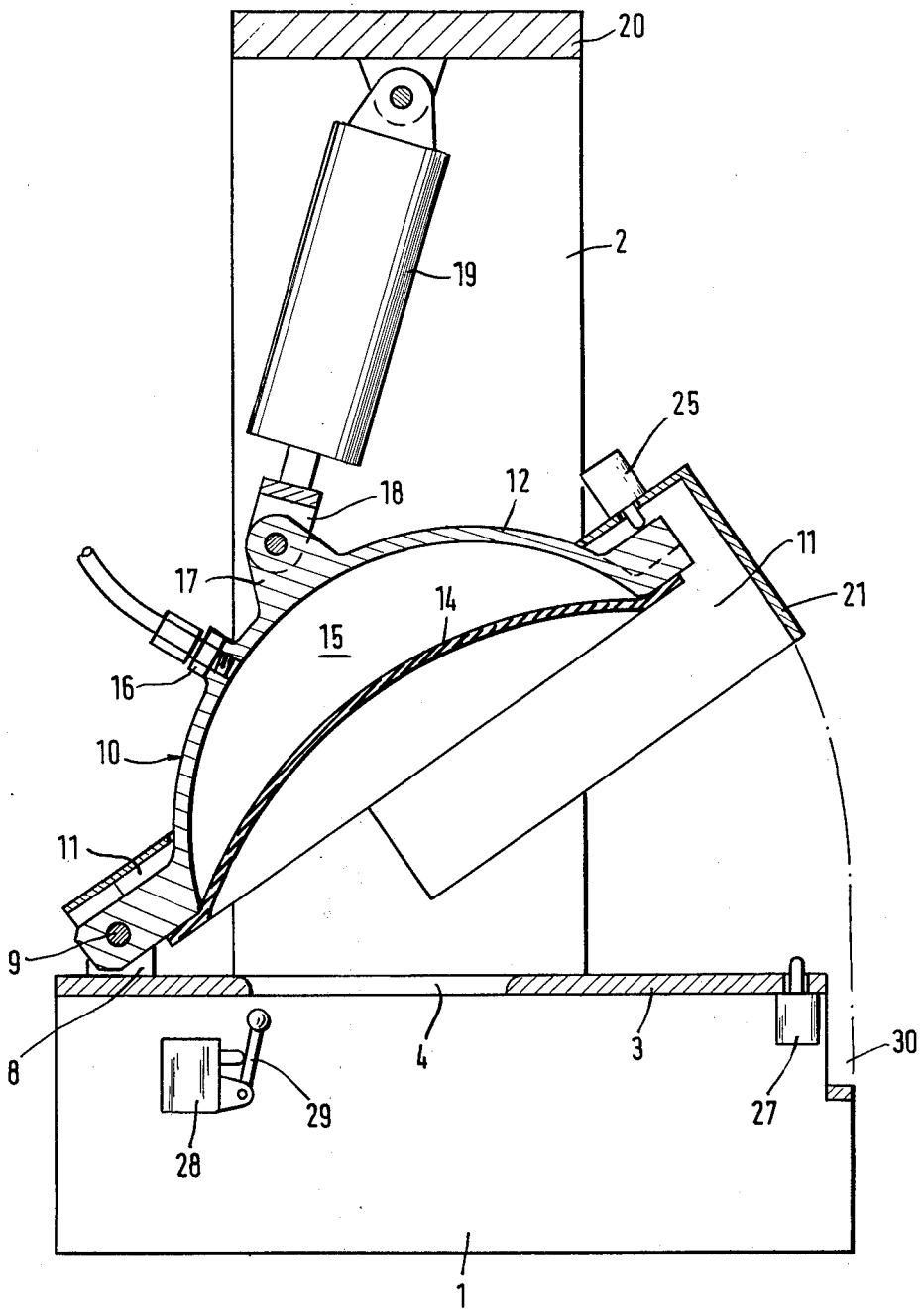
FIG. 3 shows a second embodiment of the gluing press with a variant protective hood.

In the construction illustrated in FIG. 3, which consists essentially of the same elements as that illustrated in FIG. 1 and 2 there is worked into the frame 1 a shoulder 30 into which the wall 21 of the protective hood 11 engages when it is together with the pressure cushion 10 in its bottom end position. This construction simplifies the control of the gluing press by eliminating the switch 26 acting on the emergency holding switch 25 and used in the embodiment illustrated in FIGS. 1 and 2.

Figure 4:
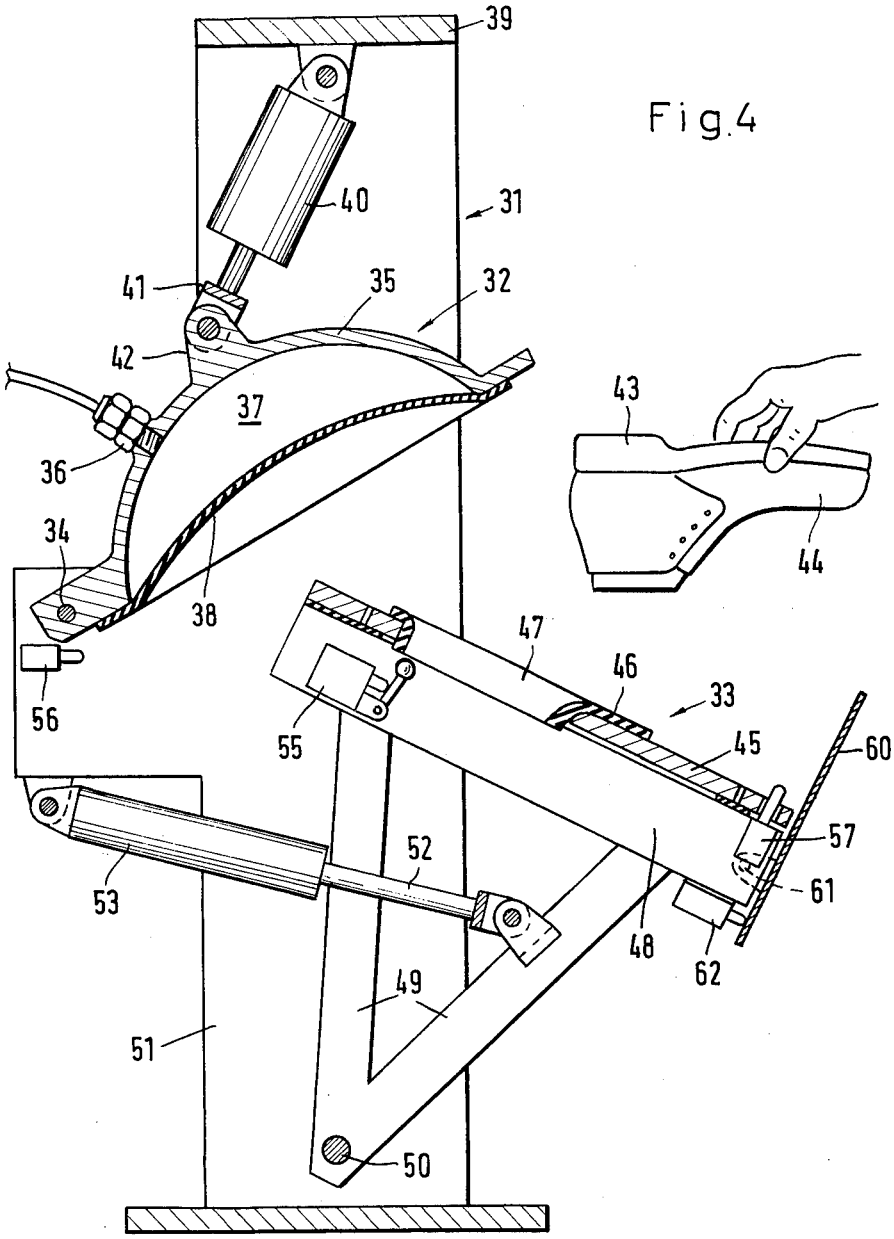
FIG. 4 is a vertical section through a further constructional gluing press with the shoe-receiving device pivoted out into the introduction position.
Figure 5:
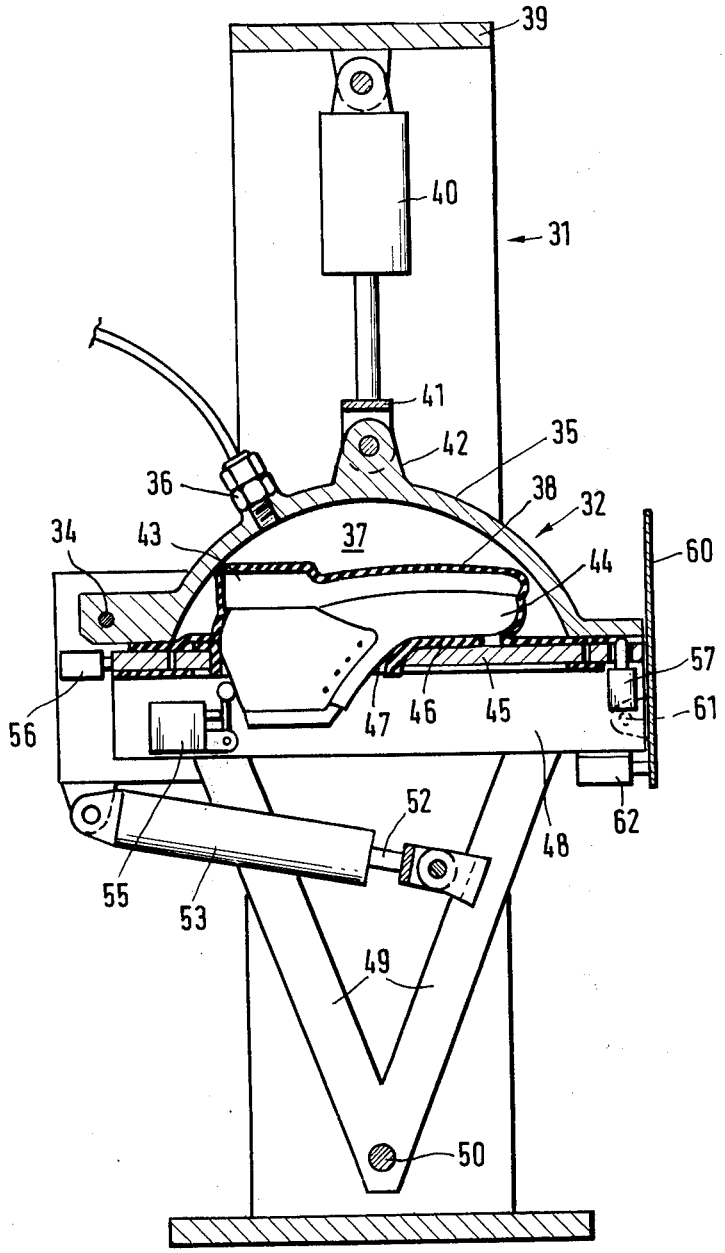
FIG. 5 shows the press illustrated in FIG. 1 in the closed, gluing position.

The press construction illustrated in FIGS. 4 and 5 also comprises a press frame 31, a pressure cushion 32 and a shoe-receiving device 33. The pressure cushion 32, articulated via a pivot pin 34 to the press frame 31, comprises a stable, hood-shaped cover 35 with a pressure medium connection 36 and a highly resilient diaphragm 38 bounding a pressure space 37 at the bottom. Articulated to a top cross-member 39 of the press frame is a pressure cylinder 40 whose piston 41 engages pivotably with a lug 42 moulded on the pressure cushion cover 35.

The shoe-receiving device 33 has a shoe-receiving plate 45 having an insertion aperture 47 lined by a sealing bead 46. The receiving plate 45 is interchangeably received in a pivoting table 48 bearing pivotably via one or two V-shaped lever arms 49 and a pivot pin 50 against a central column 51 of the press frame. The piston 52 of a pressure cylinder 53 articulated to the press frame 31 engages with one of the pivoting arms 49.

Disposed on the pivoting table 48 is a pressure lever switch 55 operatively connected to the drive 53. A limit switch 56 disposed on the press frame 31 and actuated by the shoe-receiving device 33 moving into its pressing position cooperates with the pressure cushion drive 40 and a further pressure-operated switch 57 on the pivoting table 48 is actuated by the pressure cushion moved into its lowered position and initiates the further pressing operation (cf. FIG. 5).

Attached via a link 61 to the front end face of the pivoting table 48 is a safety flap 60 connected to a safety switch 62 which, when the flap is pivoted out of its neutral position as illustrated, immediately stops the whole press or pivots the shoe-receiving device 33 back into its insertion position (FIG. 1).

This press construction operates as follows: For the insertion manually or by means of the gripper of a shoe upper 44 on its last and having a loosely applied sole 43 into the introduction aperture 47, the shoe-receiving device 33 is pivoted outwards laterally into the position shown in FIG. 1. The introduction movement of the shoe upper actuates the lever switch 55 which switches the pivoting drive 53 to move the shoe-receiving device 33 into the pressing position illustrated in FIG. 5. When the pivoting table 48 moves into the pressing position (FIG. 5) the limit switch 56 is actuated, switching on the pressure cushion drive 40 and initiating the lowering movement of the pressure cushion in the form of pivoting movement around the pivot 34. During this lowering movement of the still unpressurized pressure cushion, the highly resilient diaphragm 38 bears with a relatively slight tension against the sole surface and thereby locates the sole 43 in relation to the shoe upper 44 retained by the bead 46 in the insertion aperture 47.

The lowering movement of the pressure cushion actuates the switch 57 which opens a valve (not shown) so that a pressure medium, preferably compressed air, flows via connection 36 into the pressure space 37 of the pressure cushion 22. This pressure operative in the space 37 deforms the diaphragm 38 resiliently in a manner such that it applies itself on all sides firmly around that part of the shoe upper 44 and sole 43 projecting from the show-receiving aperture 47 and for the rest bears against the receiving plate 45. After a preselectable time the space 37 is relieved of pressure, whereafter the drives 40 and 53 successively or simultaneously move the pressure cushion 32 and the shoe-receiving device 33 into their starting position (FIG. 1).

If during the inward or outward pivoting of the shoe-receiving device any article is in the path of movement, the flap 60 pivots and actuates the switch 62 which immediately stops the whole press or, by corresponding coupling of the drives, pivots the shoe-receiving device 33 back into the starting position illustrated in FIG. 1.

Figure 6:
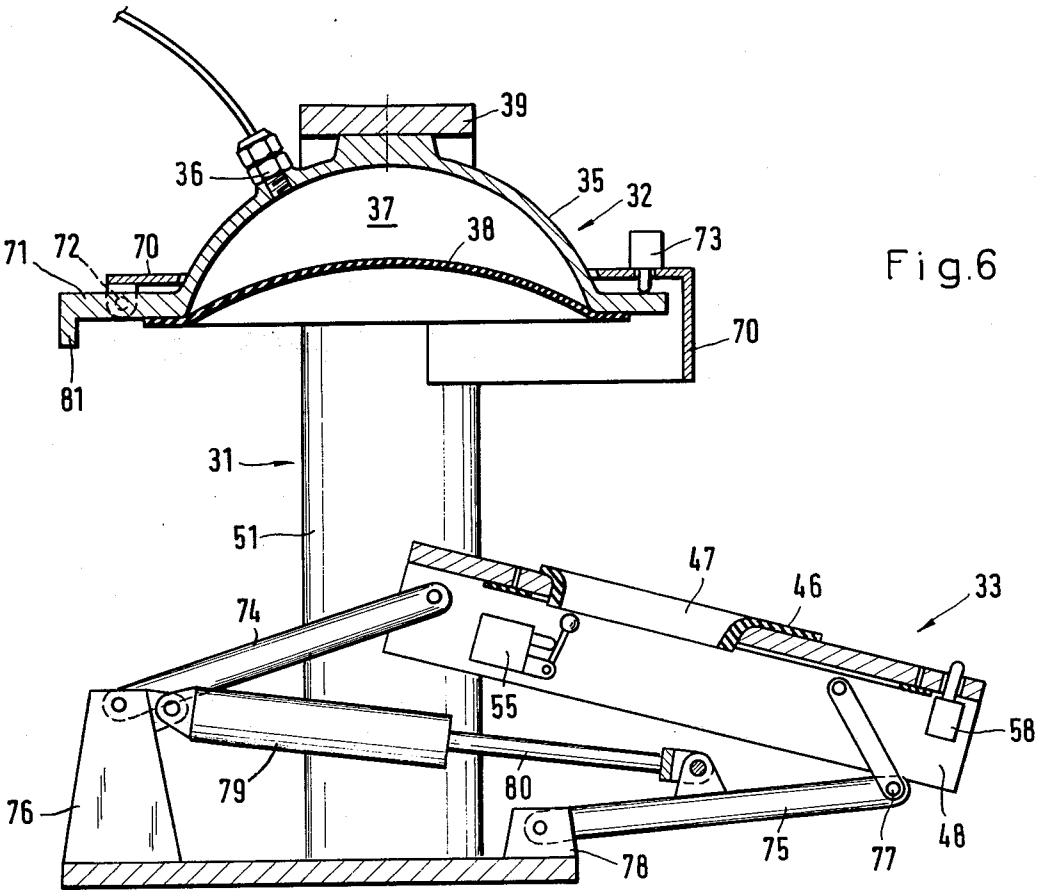
FIG. 6 is a vertical section through a further press construction with the shoe-receiving device pivoted into the introduction position.
Figure 7:
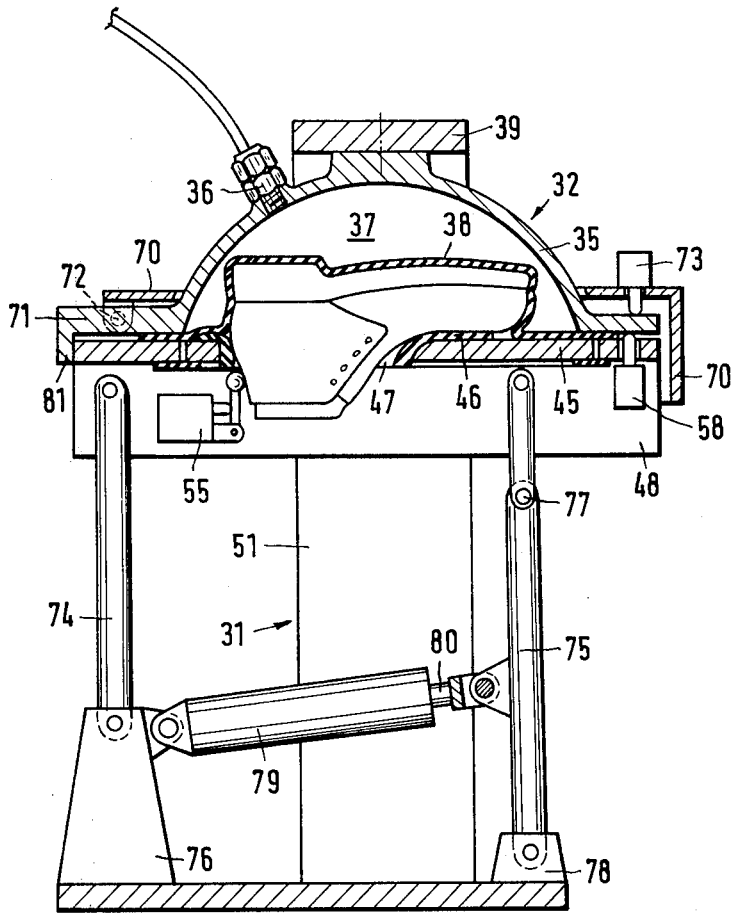
FIG. 7 shows the press illustrated in FIG. 3 during the pressing and gluing operation.

The press construction illustrated in FIGS. 6 and 7 basically corresponds to that illustrated in FIGS. 1 and 2, like members having like references. In this gluing press the pressure cushion 32 is rigidly attached to cross-member 39 of the frame 31 and at least partially enclosed by a protective hood 70 which is articulated via a pivot pin 72 to the edge 71 of the hood-shaped pressure cushion cover 35. The raising of the protective hood 70 causes a safety switch 73 connected to the drive of the shoe-receiving device by its drive immediately into the starting position illustrated in FIG. 6.

Instead of the simple V-shaped bearing of the receiving table, in this press construction a system of pivoting levers is provided which consists of at least two lever arms 74, 75 arranged in a parallelogram. The continuous lever arm 74 is articulated on the one hand to the front end of the receiving table 48 and on the other to a protuberance 76 rigidly connected to the frame 31. The other parallelogram lever 75 operates via a link 77 as a toggle lever and is articulated by both its ends, on the one hand to a lower frame protuberance 78 and on the other to the rear part of the receiving table 47. Bearing against the higher protuberance 76 is a pressure cylinder 79 whose pistion rod engages with the lower part of the toggle lever 75. However, for greater stability and rigidity of the whole gluing press, the toggle lever joint need not form a part of the system of pivoting levers, but can be constructed as a part of the pivotable pressure cushion illustrated in FIG. 5.

However, to enable the pressure exerted on the shoe-receiving device by the pressure cushion during the gluing operation to be more satisfactorily absorbed without excessive stressing of the pivoting bearings of the two parallelogram lever arms, and to obtain stable and simply constructed locking of the shoe-receiving device in the gluing position, the toggle lever link can also take the form of a separate lever linkage which cooperates with the parallelogram levers to obtain the combined pivoting movement.

As a result of the introduction of a shoe into the introduction aperture 47 enclosed by the interchangeable sealing bead 46 and the actuation of the switch 55, the piston 80 moves into the cylinder 79 and therefore pivots the two parallelogram levers 74, 75, so that the receiving table 48 performs a movement at an inclination upwards, until its front edge arrives at a stop 81 formed by the pressure cushion edge 72. Then the toggle joint 47 of the second lever arm 75 pivots as far as the closed end position of the shoe-receiving device, the switch 58 disposed on the fixed pressure cushion or on the shoe-receiving device being actuated to initiate the further gluing operations.

Figure 8:
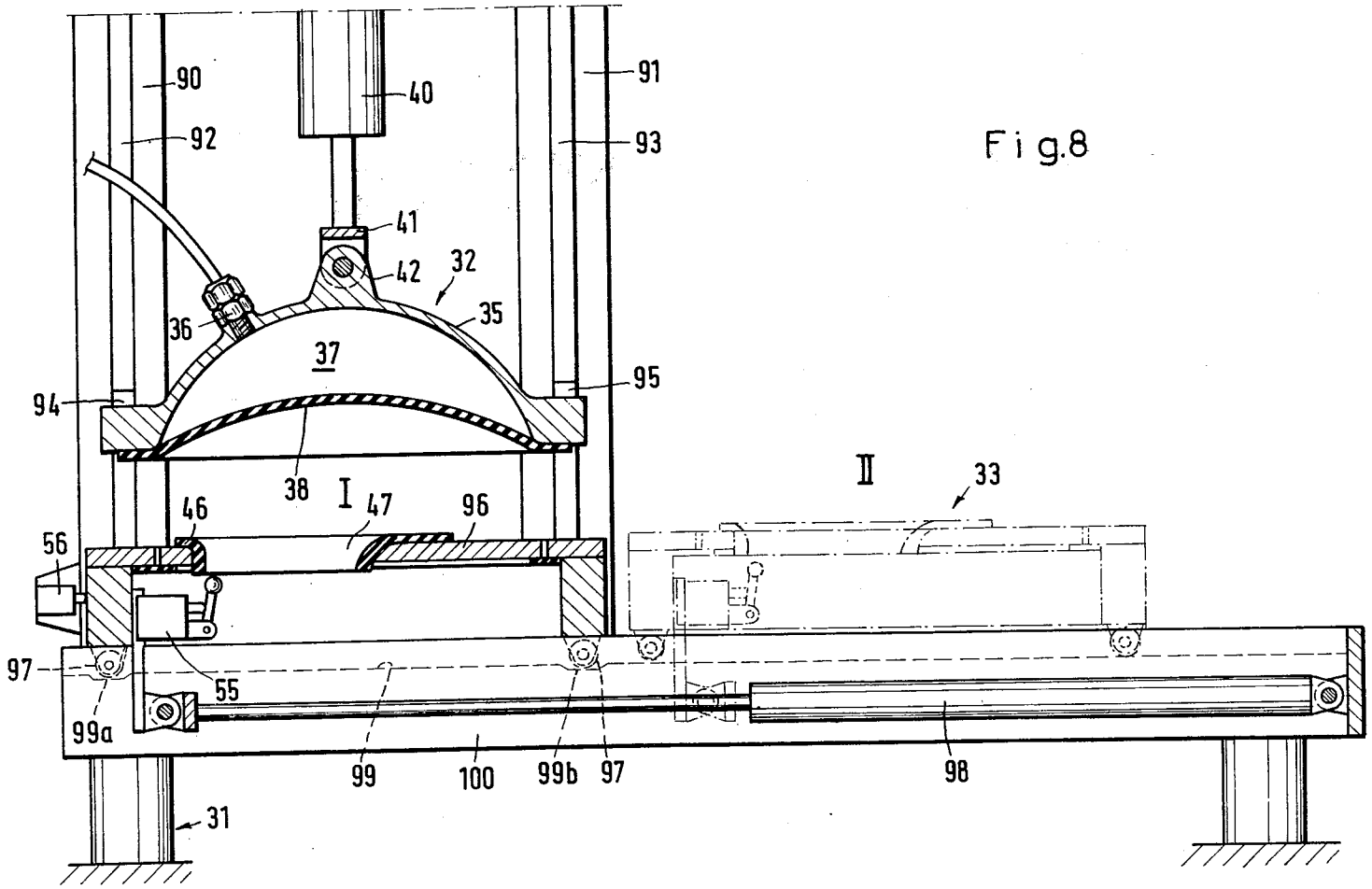
FIG. 8 shows a further press construction with a horizontally displaceable shoe-receiving device.

In the press construction illustrated in FIG. 8, the press frame 31 has two guide columns 90, 91 with vertical guides 92, 93 engaging in the corresponding guide members 94, 95 of a pressure cushion 32 which can be moved vertically by a piston 40.

The shoe-receiving device 33 takes the form of a carriage 96 which can be moved over a roller bearing 97 out of a left-hand pressing position I into an introduction position II shown in chain lines by means of a pressure cylinder 98. The rollers 97 run in parallel guide paths 99 of a bed 100, the guide paths being slightly drawn into the carriage in the pressing position at places **99*a* and 99*b*, so that in this position the rollers 97 lose pressure contact with the guide paths and the receiving carriage 96** is borne over a large area on the bed. This feature avoids excessive stressing of the roller bearings.

In this embodiment the course of the individual moving and gluing operations substantially corresponds to that in the embodiment illustrated in FIGS. 4 and 5 although this gluing press can be used particularly advantageously in production lines, since the shoe can be introduced vertically.

The invention is not limited to the footwear gluing press constructions illustrated and described, but also covers gluing presses for workpieces of different shapes, for which purpose merely a workpiece receiving device corresponding to the shoe-receiving device 3;33 must be provided and the actuating switch 28, 55 disposed and constructed in a suitable manner. The protective hood according to the invention with the projecting edges and its movement synchronous with the operative part of the gluing press, whose interruption actuates an emergency holding switch, can also be used in gluing presses having a pressure cushion moved up to the pressing and gluing surface from below.

Also instead of a shoe-receiving device with a single introduction aperture, receiving devices with a number of introduction apertures which can be moved alternately into the two operating positions can be used. It is true that this is more costly in manufacture and control, but it allows a further shortening of the gluing operation, since during the pressing and therefore gluing of one shoe, another shoe can be inserted into the second introduction aperture then exposed. In a gluing press of this kind having one or more shoe-receiving devices, it may also be convenient to move the pressure cushion laterally instead of the shoe-receiving devices.

I claim:

1. A gluing press for shoes or other similarly shaped work-pieces, having a pressure-medium-operated pressure cushion whose highly resilient diaphragm fixes the sole to be attached during the gluing operation on the shoe upper placed on a last and retained in a shoe-receiving device, a feed movement taking place between the pressure cushion and the shoe-receiving device before the gluing operation wherein a switch is disposed on the shoe-receiving device, said switch being constrainedly operated by the introduction of the shoe upper and switches on the drive for the closure movement of the operative parts of the gluing press formed on the pressure cushion and the shoe-receiving device, and a safety device is connected to one of the operative parts of the gluing press which, when deflected by an obstacle in the path of movement of the movable part of the gluing press, switches off or reverses the drive.

2. A gluing press as claimed in claim 1, wherein the shoe-receiving device is disposed with the switch disposed thereon fixed on the press frame, and the pressure cushion is constructed to move in relation to the shoe-receiving device.

3. A gluing press as claimed in claim 1, wherein the shoe-receiving device with the actuating switch and the pressure cushion can each move in relation to the other.

4. A gluing press as claimed in claim 1, wherein the shoe-receiving device together with its actuating switch is mobile and the pressure cushion is disposed fixed on the press frame.

5. A gluing press as claimed in claim 1, wherein associated with the pressure cushion which can be pivoted around a common pivoting axis together with the safety device taking the form of a projecting hood, is a switch element which in the closure position of the pressure cushion initiates follow-up control for the further operations to complete the gluing.

6. A gluing press as claimed in claim 5, wherein when the pressure cushion is raised, a loosely applied protective hood movable synchronously by the pressure cushion extends beyond its bottom edge and, when the synchronous movement is interrupted, actuates an emergency holding switch which switches off or reverses the pressure cushion drive.

7. A gluing press as claimed in claim 5, wherein the protective hood and the pressure cushion bear against one another at the same level in the closed position, and when the protective hood is closed a switch renders the emergency holding switch inoperative.

8. A gluing press as claimed in claim 5, wherein provided in the frame of the press is a recess in which the side walls of the protective hood engage in the closed position.

9. A gluing press as claimed in claim 4, wherein for the insertion of the shoe upper the shoe-receiving device can be moved out of its pressing position into a lateral introduction position, the switch actuated by the insertion of the shoe upper in the recess directly initiating the retrun movement of the shoe-receiving device from its lateral introduction position into its pressing position.

10. A gluing press as claimed in claim 9, wherein the shoe-receiving device is borne via a system of pivoting levers and can be pivoted by a drive out of its pressing position into a lateral introduction position and vice versa.

11. A gluing press as claimed in claim 10, wherein the system of pivoting levers is at least one V-shaped arm which can be pivoted around the pivoting axis and with which the piston rod of the drive taking the form of a pressure medium cylinder pivotably engages.

12. A gluing press as claimed in claim 10, wherein the system of pivoting levers comprises two lever arms which are disposed in the form of a parallelogram and are articulated at different heights to the press frame, a toggle lever linkage being provided to lock the shoe-receiving device against the pressing pressure.

13. A gluing press as claimed in claim 9, wherein the shoe-receiving device taking the form of a carriage and having one or more introduction apertures is provided with means for horizontal displacement on a bed and can be moved by a drive out of its pressing position into a lateral introduction position.

14. A gluing press as claimed in claim 1, wherein the drive for moving the shoe-receiving device is associated with the switch actuated by the introduction of the shoe upper, a limit switch actuated by the shoe-receiving device pivoted into the gluing position is connected to the drive for lowering the pressure cushion, and an operating switch actuated by the lowered pressure cushion is provided for initiating the gluing operations on the shoe-receiving device.

15. A gluing press as claimed in claim 9, wherein the drive for moving the shoe-receiving device is associated with the switch operated bythe introduction of the shoe upper, and a limit switch actuated by the shoe-receiving device in its end position is provided for immediately introducing the pressure medium into the fixed pressure cushion.

16. A gluing press as claimed in claim 9, wherein a safety flap disposed on the front side of the movable shoe-receiving device actuates a safety switch when pivoted by an obstacle.

17. A gluing press as claimed in claim 1, wherein the highly resilient diaphragm disposed on the pressure cushion is forced by residual stress on to the walking sole to be glued, as a result of the movement of the pressure cushion and/or the shoe-receiving device towards one another.

18. A gluing press as claimed in claim 1, wherein the introduction aperture, lined with an interchangeable resilient sealing bead is so constructed in the shoe-receiving device that the shoe upper is borne substantially along one level of its last.

19. A gluing press as claimed in claim 1, wherein the insertion aperture is worked into a plate interchangeably disposed in the shoe-receiving device.

* * * * *